US005417229A

United States Patent [19]

Summers et al.

[11] Patent Number: 5,417,229

[45] Date of Patent: May 23, 1995

[54] ORGANOLEPTIC BITE COMPOSITION FOR HUMAN CONSUMPTION

[76] Inventors: John K. Summers, 660 E. 600 S., Anderson, Ind. 46013; Kenton D. Summers, deceased, late of Anderson, Ind., by John K. Summers, legal representative

[21] Appl. No.: 94,757

[22] Filed: Jul. 20, 1993

[51] Int. Cl.[6] ..... A24B 15/00

[52] U.S. Cl. ..... 131/359; 131/275; 131/352

[58] Field of Search ..... 131/352, 359, 369, 275

[56] References Cited

U.S. PATENT DOCUMENTS

| | | | |
|---|---|---|---|
| 160,138 | 2/1875 | Appleby . | |
| 2,930,720 | 3/1960 | Finberg . | |
| 2,943,958 | 7/1960 | Schoflander | 131/359 |
| 3,067,068 | 12/1962 | Finberg . | |
| 3,112,754 | 12/1963 | Diaz . | |
| 3,323,524 | 6/1967 | Shamberger . | |
| 4,696,315 | 9/1987 | Summers . | |
| 4,817,640 | 4/1989 | Summers . | |
| 4,887,620 | 12/1989 | Summers . | |

FOREIGN PATENT DOCUMENTS

| | | |
|---|---|---|
| 842 | 4/1766 | United Kingdom . |
| 2427 | 10/1859 | United Kingdom . |

OTHER PUBLICATIONS

Lucas, *Common and Uncommon Uses of Herbs for Healthful Living*, Ch. 16, "Herbal Smoking Substitutes for Tobacco", pp. 141–150, 1969.

*Primary Examiner*—Jennifer Bahr

*Attorney, Agent, or Firm*—Hoffmann & Baron

[57] ABSTRACT

A composition for use as a snuff or chew and providing a sustained organoleptic bite, including a nicotine-free herbal component made of alfalfa, either alone or in combination with chicory, clover or mixtures thereof, as well as a casing material, serving to moisten, sweeten, and provide flavor to the herbal component and to keep the herbal component as a coherent cud in the mouth during use. The casing material also includes cayenne pepper in amounts providing a satisfactory approximation of the bite of a tobacco containing composition. Also, a method for preparing such compositions, involving at least two separate applications of cayenne pepper to alfalfa-based herbal mixtures for use as a snuff or chew.

16 Claims, No Drawings

ORGANOLEPTIC BITE COMPOSITION FOR HUMAN CONSUMPTION

BACKGROUND OF THE INVENTION

1. Field of the Invention

This invention relates to simulated tobacco snuff and chew compositions containing various known herbs of which Alfalfa, (*Medicago sativa/falcata*) and chicory, (*Cichorium intybus*) are the principal or essential herbs thereof.

2. Background of the Related Art

The Surgeon General of the United States has determined that tobacco is dangerous to one's health, as evidenced by the presence of cancer warning labels on all tobacco products.

Tobacco snuff and chew compositions utilize certain additives along with the tobacco nicotine to produce a sustained mucosal bite, resulting in a slight burning sensation in the oral cavity. It is important that compositions which are intended to replace tobacco and other nicotine-containing materials impart the same or nearly the same organoleptic sensations, so that the user will be willing to use the substitute in place of the tobacco containing substance. Thus, in order to approximate the oral sensation of tobacco in mucosal tissue, it is desirable to provide the sensation, commonly referred to as organoleptic bite, found in the tobacco-containing materials. This organoleptic sensation can be difficult to produce, since an increase in additives which provide a bite can create an undesirably high intensity burning sensation and hot spots in the mouth.

U.S. Pat. Nos. 6,887,620, 4,817,640 and 4,696,315, recently issued to one of the inventors herein, addressed this issue and sought to provide a tobaccoless chewing and snuff composition to ameliorate the harmful effects associated with addictive use of tobacco-containing chewing and snuff compositions. The disclosure of each of these patents is incorporated by reference herein. U.S. Pat. No. 4,696,315 discloses a herbal chewing tobacco and snuff composition including red clover herb mixed with dandelion, slippery elm bark, and a casing method for maintaining the composition in a moist coherent state during chewing. The casing can include molasses, sea salt, ginger, cayenne, rose hips and other materials to impart the taste, texture and bite as chewing tobacco and/or snuff. U.S. Pat. No. 4,817,640 discloses a tobaccoless herbal composition which can also include dandelion, papaya, dock or sorrel, sunflower, calendria, nasturtium, mallow, chicory and corn silk. Clover, specifically red clover, is also used with a snuff composition using these herbal ingredients, while for a chew composition, a combination of dandelion and dock or sorrel are described as preferred. An absorptive binder, preservatives, flavorings, such as cayenne and/or sweeteners, humectants and various bio-effecting agents are also described as being optionally added to the composition. Additionally, the more recently issued U.S. Pat. No. 4,887,620 discloses a tobaccoless herbal chew or snuff composition providing a sustained organoleptic bite sensation through a two-stage use of cayenne pepper powders.

Other attempts to reduce the use of nicotine by decreasing the amount of nicotine-containing material are described in U.S. Pat. Nos. 2,930,720 and 3,067,068, both to Finberg, that disclose smoking and snuff compositions which are substantially nicotine-free. Both of these disclosures require the use of non-tobacco leaves, namely papaya leaves.

Other patents addressed to solving the nicotine problem include U.S. Pat. Nos. 3,112,754, 3,323,524 and British Patent No. 842 granted in 1766, as well as, U.S. Pat. Nos. 160,138, 3,112,754 and British patent No. 2427 granted in 1859.

Accordingly, a purpose of this invention is to provide a simulated tobacco snuff and chew composition which is safe to the health of the user by avoiding the inclusion of tobacco and nicotine.

Another purpose of this invention is to provide a simulated snuff and chew composition which produces a certain mucosal bite that maintains a slight burning sensation in the mouth without the presence of hot spots while avoiding the use of tobacco nicotine.

Another goal of the present invention to provide a simulated tobacco snuff and chew composition containing natural herbal ingredients free from artificial chemicals, and which exhibits the same texture, taste, bite and lift as fine quality tobacco snuff and chew, but is not irritating or damaging to the health of the user.

It is still a further purpose of this invention to provide composition which does not require expectorating.

Yet another purpose of this invention is to provide a composition which includes a preparation of herbs aiding in salivation.

Still another purpose of this invention is to provide a herbal snuff and chew composition that imparts energy and alertness to the user.

Another purpose of this invention is to provide a tobacco-free snuff and chew composition that exhibits the same desirable properties, texture and feel as commercially available tobacco containing snuff compositions.

SUMMARY OF THE INVENTION

These and other purposes and goals of the present invention are achieved by a simulated tobacco snuff and chew composition which includes various known herbs of which alfalfa (*Medicago sativa/falcata*) and chicory (*Cichorium intybus*) are the principle or essential herbs in admixtures with other natural leaves.

The present invention is a composition for providing a sustained organoleptic bite sensation, as well as procedure for making such a composition.

The invention is directed to compositions capable of being used as snuff or chew materials and employing nicotine-free herbal components in place of traditional tobacco-based blends. In particular, the invention uses alfalfa as the principal and essential herbal component, and uses alfalfa either alone or in conjunction with chicory, clover or mixtures thereof. Any of these herbal mixtures should be capable of being processed to a texture which is non-injurious to the mucosal membranes lining the interior of the mouth. The herbal component should also be capable of being encased in a casing material which provides moistness, sweetness and a flavor to the herbs and which maintains the herbs in a coherent cud in the mouth when being used.

The present compositions include the use of cayenne pepper ground to a size which is from about #30 Duraloy (#20 U.S.) to about #58 Duraloy (#48 U.S.), and is preferably about #54 Duraloy (#45 U.S.). The pepper also preferably has a selected heat content, between about 5,000 and about 10,000 BTU's, and preferably about 5,000 BTU's. This particular heat content, in combination with the size of pepper prescribed herein, is highly desirable since it is possible to use a sufficiently large amount of the pepper throughout the composition to provide a sustained bite sensation without creating unwanted hot spots which dissipate quickly in the oral cavity. Cayenne pepper in the liquid form may also be used with the present compositions.

This invention is particularly useful when used with tobaccoless chewing or snuff formulations in order to approximate the bite sensation of a tobacco-containing composition. When used with a nicotine-free herb as a replacement for a tobacco-containing chew or snuff composition, the pepper is preferably added in two portions, the first portion being added to the base mixture of herbs prior as an ingredient in a casing material, which usually includes a humectant, preservative, and binder. The chewing or snuff composition can then be further enhanced by applying the second portion of the pepper in a top dressing mixture which can be sprinkled on the composition after it has been encased, and preferably, after it has been bulked by storage at a selected temperature and humidity conditions.

It has been found that the pepper is preferably included in a tobaccoless chewing or snuff composition in an amount from about 0.1% to about 4.0% by weight. When the pepper is added in the two portions as specified above, from about 70% to about 80% of the total amount of pepper should be added in the base material, while from about 20% to about 30% of the total pepper should be included in the top dressing. In this way it has been found that an initial burst of bite or burn sensation can be provided to the oral cavity of the user, while a sustained bite, approximating the presence of a tobacco-containing composition, is achieved.

As a result of the present invention, a nicotine-free chew or snuff composition can be provided which has an organoleptic bite sensation approximating that of a tobacco-containing composition. Moreover, the composition can be provided which has an initial burst of bite sensation as well as a sustained bite or burn sensation for a long period of time. These effects can be provided without creating an excessively high intensity bite which would detract from the product.

For better understanding of the present invention, reference is made to the following description and tables, the scope of which is pointed out in the claims.

DETAILED DESCRIPTION OF THE INVENTION

One embodiment of the present invention is directed to tobacco-free or substantially tobacco-free snuff compositions including a blend of different herbs and a blend of different "casing" materials. The term "casing" is used in the same manner as disclosed in U.S. Pat. No. 3,057,068 the disclosure of which is incorporated by reference herein. Another embodiment of the present invention is a tobacco-free or substantially tobacco-free herbal chew composition. A discussion of the preparation of the various herbs and their processing for use in a snuff or chew composition consistent with the present invention is generally described in U.S. Pat. Nos. 4,696,316 and 4,817,640, the disclosures of which are incorporated by reference herein.

An important and unique aspect of the compositions of the present invention is the application of a mucosal bite quality in the product since the present invention is designed to remain in the mucosal area for a prolonged period of time, it is essential to find a combination of ingredients that merge this bite (slight burning sensation) into the product evenly so as not to cause a so-called "hot spot" effect, or bring discomfort in the oral cavity. The purpose is to provide a sustained oral sensation.

The present invention provides a composition which causes a sustained organoleptic bite sensation. The composition, therefore, includes powdered cayenne pepper ground to a size which is from about #30 Duraloy (equivalent to #20 U.S.) to about #58 Duraloy (#45 U.S.). The powdered form of cayenne pepper has a pre-selected heat content, between 5,000 and 40,000 BTU's, preferably from 5,000 to about 10,000 BTU's, and most preferably about 5,000 BTU's. These levels can be accurately measured by means of the Scobal test. It has been determined that a very important step in the preparation of the powder is the gravity and air sifting of the powder in order to ensure the correct size of granules. With these prescribed combinations, it has been found that a sustained bite sensation can be created without undesirable hot-spots which dissipate quickly in the oral cavity.

Cayenne pepper is also incorporated into the top flavorant of the product to provide an immediate-bite sensation, much the same as that produced by mint or clove in candy and gum, that is sustained throughout the duration of the use of the product. Alternatively, a liquid preparation of cayenne pepper may be employed as the top flavorant, providing a more even immediate-bite sensation. This is especially important and useful when used with a tobaccoless chewing or snuff formulation in order to approximate the bite sensation of the tobacco-containing composition. When used in the nicotine-free herbal snuff which is a replacement for a tobacco-containing chew or snuff composition, the pepper is preferably added in two different operations, the dry powder being blended into the liquid base casing mixture, thus encapsulating it in the casing material which includes a humectant, preservative, and binder. The bite sensation of the chewing or snuff composition can then be further enhanced by adding a second portion of cayenne powder or cayenne liquid. This is accomplished by blending the cayenne into the liquid flavoring which is applied as a final outer coating, or top dressing, to the already encased material. It is preferable to apply this final flavoring not sooner than 1 week following production of the material, and following bulking and storage at selected temperature and humidity conditions.

It has been found that the cayenne pepper is included in a tobaccoless chewing or snuff composition in an amount of from about 0.1% to about 4.0% by weight, preferably from about 0.15% to about 3..0% by weight. When the pepper is added in the two portions as specified above, from about 70% to 80% by weight should be added in the base casing, and about 20% to 30% by weight added to the top dressing. After prolonged experimentation, it has been found that this formula gives a mild initial bite in the oral cavity, while sustaining a prolonged underlying bite through the medium of the fine powder. Thus, the present invention achieves a similar sensation as that experienced in the use of a tobacco-containing composition.

It has been found that the use of the cayenne in the manner described above is a preferable method of application, ensuring a more adequate total distribution in the product, as well as giving the effect of two layers of bite producing the sum total of oral sensation. This invention results in a nicotine free chew or snuff composition approximating that of a tobacco-containing composition. This method gives a true initial burst of bite as well as the desired sustained bite for a longer period of time than by previously devised compositions, and, additionally, ensures the absence of hot spots in the composition.

1. Principal Herbal Ingredients

The particular herbs that are combined in the herbal blend making up the preferred compositions of the present invention are all commercially available. These herbs are described in details as follows:

A. Alfalfa (*Medicago Sativa*)

Alfalfa, as used in the present invention, is essentially the leafy portion of the plant, containing the Provitamin A (Beta-carotene), Vitamins C, D, E and K; as well as mineral salts such as calcium, potassium, iron and phosphorous. The leaves are used commercially and in healing ointments as a source of chlorophyll, carotene and Vitamin K. The leaves are often eaten fresh like spinach. Alfalfa contains at least one protein with known antitumor activity, and possesses anti-bacterial action against gram negative bacteria; see the article by Tyihak and Szende, "Basic Plant Proteins with Antitumor Activity," in *Journal of Science, Food and Agriculture,* 22(4), 168–172 (1971); and the Hungarian Patent No. 798 (1970); respectively. Alfalfa is also a valuable fiber, and has been found to bind and neutralize various types of agents carcinogenic to the colon; see, *Journal of the National Cancer Institute,* 67(2), 495–497 (1981). Among several other benefits, alfalfa has been found to reduce tissue damage caused by radiotherapy; see, French Patent 2,187,328 (1974). Recent research has found that alfalfa saponins inhibit increases in blood cholesterol levels by 25% when high cholesterol diets are fed to monkeys; see, *VIth International Symposium on Atherosclerosis,* Tokyo, Japan (1976). Some work suggests that alfalfa induces activity in a complex cellular system that inactivates dietary chemical carcinogens in the liver and small intestine before they have a chance to do the body any harm. See Wattenberg, "Effect of Dietary Constituents on the Metabolism of Chemical Carcinogens, " *Cancer Research,* 35 3326–3331, , (1975). Thus, when the alfalfa-containing snuff juice is swallowed, there are certain beneficial effects that can be expected.

The alfalfa plant is harvested by cutting the entire plant, and drying by either natural solar rays, or by commercially available drying devices. The plant is dried to approximately a 25% level and then separated by commercially available rotational and gravitational separators specially designed for that purpose. The leaves are then milled to the desired consistency, generally described as either course or fine cut. The leaves can also be milled into a fine powder form. The alfalfa is then included in the compositions of the present invention in an amount ranging from 15% to 35% by weight, 32.2% being preferred in the finer cut when used as a single herb.

B. Chicory (*Cichorium intybus*)

Chicory has been used for centuries as a salad green, and is now cultivated in many hybrid species. The inventor has carefully researched this plant and has found it to contain a high percentage of latex in the branched system of latex tubes in the plant. Because its high latex content, chicory plays an important role as one of the main dry herbs in both the snuff and leafy chew compositions of the present invention. The latex provides a natural binder to prevent the leaves from breaking up in the composition, and giving the product a long lasting form as a chewing substance.

*Cichorium intybus* is the wild form of chicory, and extensive experience has shown it to be undesirable in the present compositions due to factors of woodiness, bitterness, and characteristics of growth. The hybridized forms useful in the present compositions were developed by Italian growers. The three forms are San Pasquale, Verona, and Catalogna Veneto, with San Pasquale the preferred hybrid.

Chicory is used in the composition of the present invention in amounts ranging up to 10%, about 4.4% by weight being preferred when used in combination with other herbs.

C. Sweet Clover (*Melilotus officinalis* and/or *Melilotus vulgaris*)

Sweet clover is a leguminous herb containing a glycoside, and a melilotoside, and which, upon drying, produces coumarin or coumarin anhydride, $C_9H_6O_2$, which gives it a very sweet taste and fragrance, with a vanilla-like odor. Sweet clover is included in the composition of the present invention in an amount ranging up to about 10% by weight, 7.1% being preferred when used in combination with other leafy herbs.

2. Principal Casing Ingredients

The casing materials used in the present invention preferably include:

A. Cayenne (*Capsicum frutescens*)

Cayenne, as described above, in either the powdered or the liquid state is used in the composition to give a certain quality of what is known in the tobacco art as "bite". Included in the casing, and the final liquid flavor, it has been found to provide both immediate and prolonged bite sensation in the oral cavity for the duration of use. Depending on the BTU rating of the cayenne used, a range of from about 0.1% to about 4% by weight is acceptable, with from about 0.15% to about 0.30% being preferred. BTU ratings range from 5,000 to 1,000,000 units. In the blend, a lower BTU rating is desirable, with a BTU rating for cayenne powder of about 5,000 being preferred.

The amount of liquid cayenne used also depends on its B.T.U. rating, which can range from about 100,000 B.T.U. to about 1,000,000 B.T.U. A lower B.T.U. rating is preferred, with the more preferred B.T.U. rating being about 100,000 B.T.U. The amount of liquid cayenne (100,000 B.T.U.) included in the composition can range from about 0.01 gram to about 0.08 gram for every pound (454 grams) of the composition. Preferably, liquid cayenne (100,000 B.T.U.) may be included in an amount of about 0.4 gram for every pound of the composition. Liquid cayenne may be added to the flavorant of the present compositions in amounts of from about 5 wt. % to about 50 wt. % of the total cayenne in the product, with an amount of from about 20 wt. % to about 30 wt. % being preferred. Using the preferred quantity of liquid cayenne will provide the desirable approximation of the immediate organoleptic bite sensation found in the use of tobacco products.

Cayenne pepper is preferred as the pepper ingredient in the compositions of the present invention because of its relatively strong organoleptic bite. Cayenne pepper is also preferable because it is relatively flavorless, as compared to such other peppers a black pepper and white pepper, and thereby does not unduly interfere with the desired flavor structure of the compositions.

B. Marshmallow Root (*Althaea officinalis*)

The marshmallow is demulcent and mucilaginous, containing up to 35% mucilage, (bassorin, althea mucilage). The root of Marshmallow was the original main ingredient in the white spongy marshmallow confection, but it is no longer used for that purpose. It contains Asparagus, (althein, amido )-succinamide) -succinic acid, asparamide). It soothes mucous membranes, and has been used for hundreds of years as a wound healer. It is used in the snuff composition as a natural ingredient to maintain what is known to provide "pack and consistency" to the composition of the present invention. Marshmallow is utilized in range from about 0.25% to about 1.0% by weight of the ingredients, with about 0.73% being preferred.

C. Slippery Elm (*Ulmus fulva,* and/or *Ulmus glabra*)

The Slippery Elm is also demulcent and mucilaginous, containing as much as 50% mucilage. It is derived from the inner bark of *Ulmus fulva,* which is dried and ground to a very fine powder, known to be highly nutritious. It is used in conjunction with the Marshmallow Root to create an accelerated binder that assists in maintaining the coherency and consistency of the composition of the present invention. The inventor has found that combining both the marshmallow root and slippery elm produces a superior form of binder than when used independently of each other.

Slippery elm is utilized in the composition of the present invention in a range from about 0.2% to 0.75% by weight of the ingredients, 0.44% being preferred.

D. Salt

Salt, as an extremely fine ground ingredient functions as a preservative, increases salivation, and enhances taste. It may be utilized in a range of about 3% to about 6% by weight, with about 4% to about 5% being preferred.

E. Ginger (*Zingiberis officinale*)

Ginger derived from the root of the ginger plant in powdered or liquid form functions to improve both bite and taste in certain flavor combinations of both the snuff and/or the leafy chew, and may be employed in amounts ranging from about 0.05% to about 0.5% by weight, with about 0.1% to about 0.2% being preferred. Ginger contains vitamins A, C and elements of the B complex, along with several minerals. Ginger is also known to be good for the respiratory system. The ginger may be of various international origins.

F. Licorice

Powdered licorice is added to the composition to perform at least two functions. Licorice acts as a sweetening agent and is known to be a good stomachic agent; coating and thereby soothing and protecting the stomach lining. Licorice may be added in an amount ranging from about 0.3% to about 2.0% of the composition by weight. It is preferred that licorice be added in an amount ranging from about 0.5% to about 1.3% by weight. Most preferably, licorice may be added to comprise about 0.66% of the weight of the composition.

G. Molasses

Various forms of molasses and unsulfurized molasses are used in the compositions of the present invention essentially as a binder, also functioning as a humectant and a natural sweetener. Molasses makes up about 70% to about 75% by weight of the moist ingredients, with about 71% preferable.

H. Corn Syrup

Corn syrup is a widely used natural sweetener, and adds sweetness to the composition as well as serving as a humectant, maintaining the moistness of the composition. Corn syrup may be added in an amount ranging between about 5% and about 25% with the preferred range between about 10% and about 15% of the weight of the composition. Most preferably, about 11.4% of the weight of the composition will be corn syrup.

I. Mint Oils

Both natural and artificial mint oils are used in the compositions of the present invention. These oils include such ones as Spearmint (*Mentha spicata*), Wintergreen (*Pyrola rotundifolia*), and Peppermint (*Mentha piperita*), which are added to the liquid ingredients for both casing and final flavor.

J. Caramel Color

Caramel color is included in the casing ingredients to impart the desired degree of darkness to the product, also imparting sweetness to the compositions of the present invention. It is included in amounts from about 0.5% to about 10% by weight, with about 1% to about 5% being desirable. Most preferably, caramel color will be present as about 2.2% of the weight of the composition.

K. Glycerine

Glycerine is used in the casing to provide additional humectant qualities, also adding sweetness to the composition It is included in amounts from about 0.2% to about 10% by weight of the liquid ingredients with about 5% to about 7% being desirable. It is most preferable that glycerine be added as about 6.8% of the weight of the composition.

L. Sodium Bicarbonate

Sodium Bicarbonate is added to the composition to act as a buffer, neutralizing the acidity produced by the other components. Sodium bicarbonate is added in amount from about 3% to about 7% by weight, with a range of about 4% to about 5% being desirable. The most preferred amount of sodium bicarbonate is about 4.4% of the weight of the composition.

M. Ammonium Chloride

Ammonium Chloride is added to duplicate the odor of ammonia that is often emitted from tobacco containing products, and that would otherwise be missing from the composition of the present invention. Ammonium chloride is added in amounts ranging from about 1% to about 5% by weight, with a range of about 2% to about 3% being desirable. Most preferably, ammonium chloride is added in an amount constituting about 2.2% of the weight of the composition.

N. Distilled Water

Water is used in varied amounts to aid in blending the composition, and imparting moistness and softness to the dry ingredients. It also serves as a thinner for the moist ingredients in the casing.

3. Ancillary Casing Ingredients

Ancillary casing ingredients in addition to the principal casing ingredients may be included in the herbal snuff or chewing composition as follows:

A. Flavors

Various natural and artificial fruit flavors, as disclosed in U.S. Pat. No. 3,112,754, incorporated by reference herein, are principally deemed important for imparting a particular flavor. Such flavors may include an infinite variety and quantity.

In the compositions of the present invention, the flavorings are added to the casing in various quantities depending upon the desired intensity and quality of the taste. In the examples of snuff compositions provided below, it will be noted that the preferred amounts and proportions of the casing and herb ingredients remain constant regardless of the quantity of flavoring added. In this way the ancillary nature of the flavoring may be seen, while the relative amounts of the herb and casing ingredients are relatively invariant.

In Examples 1–4 below, two principal flavorings have been included as representative of the kinds and amounts of flavoring that may be employed in conjunction with the snuff compositions of the present invention. The wintergreen and peach/rum flavorings are obtainable in liquid form from International Flavors and Fragrances, Inc. of Ocean Beach, N.J.

In the compositions of the present invention, it is preferred that the wintergreen flavor be added in amounts in the range of from about 1 gram to about 10 grams for each 454 grams of the composition. More preferably between about 2 grams and about 5 grams of the wintergreen flavor are added to each 454 grams of the preferred snuff composition. It is most preferred that about 3.31 grams of the wintergreen flavor be employed as, is illustrated in Examples 1–4 below.

In the compositions of the present invention, it is preferred that the peach/rum flavoring be added in amounts in the range of from about 10 grams to about 25 grams per 454 grams of the preferred snuff composition. More preferably the peach/rum flavoring may be added in amounts ranging from about 15 grams to about 20 grams for each 454 grams of snuff. It is most preferred that about 17.67 grams of peach/rum flavoring be added to each 454 grams of the preferred composition of snuff.

B. Gums

Certain gums such as gum tragacanth, gum arabic, gum acacia, and gum karaya may be used in such amounts as are desirable to enhance what is known in the tobacco industry as "pack".

C. Preservatives

Certain preservatives such as methyl paraben and sodium benzoate powders may be included in the composition, all of which are FDA approved to be included in such products to retain freshness and purity.

D. Sweeteners

Saccharin or other concentrated sweeteners, such as aspartame may be included in the composition of the present invention in dry form to impart a desired sweetness to the product. Saccharin has been declared safe for human use, and is utilized in the composition in a range from about 0 1% to about 0.3% by weight, with about 0.2% being preferred.

E. Other Ingredients

Certain other ingredients, such as niacin, rutin, bioflavonoids, vitamins and minerals, may be incorporated into the composition to increase salivation, and enhance the overall nutritional value of the product. In the case of niacin, it is quickly absorbed by the mucosal tissue during the chewing process, causing the blood vessels to dilate, producing what is called a "niacin rush".

The casing material is used in varying amounts as a means of binding the mixture together, for providing the desired amount of moisture, for imparting certain beneficial digestive qualities, and for imparting a desired flavor to the final product.

The casing material may be used in lesser or higher concentrations depending on the individual product being produced. In the case of the leafy chew, higher amounts of casing are used, but are wrung out by centrifugal force, and dried down to a lesser total weight than in the snuff. The particular combination of herbs, casing materials, flavor and color components, and binders for making either tobacco-free snuff or chew compositions are disclosed in U.S. Pat. No. 4,817,640 and incorporated by reference herein. The following examples provide especially preferred combinations of the above described ingredients according to the present invention.

EXAMPLES

TABLE I

PREFERRED HERBAL SNUFF COMPOSITION

| Ingredient | % By Weight |
|---|---|
| Nicotine-Free Herbal Component | 32 to 37 |
| Casing Component | 45 to 55 |

The snuff composition can also include, as in the case of the chewing composition, a flavorant component, a color component, and an additional non-casing herbal binder component. When these additional components are used they can be provided in the following percentages.

TABLE II

PREFERRED FLAVORED HERBAL SNUFF COMPOSITION

| Ingredient | General % By Weight | Preferred % By Weight | Most Preferred % By Weight |
|---|---|---|---|
| Flavor Component | 0.25 to 7 | 1.2 to 5.0 | 2.25 to 4.0 |
| Color Component | 0.25 to 5 | 0.8 to 3.0 | 1.00 to 1.8 |
| Herbal Binder | 0.50 to 5 | 0.8 to 3.0 | 0.10 to 2.0 |

Examples of the preferred snuff composition have been prepared using the above general formulas, as set forth below:

Example 1

TABLE III

RED RIVER MOIST SNUFF

| | Wintergreen | | Peach/Rum | |
|---|---|---|---|---|
| | Weight (Grams) | % of Total Weight | Weight (Grams) | % of Total Weight |
| Herbal Ingredients | | | | |
| Alfalfa Leaves | 146.3 | 32.2 | 146.3 | 32.2 |
| Casing Ingredients | | | | |
| Cayenne 5,000 BTU | 8.18 | 1.8 | 8.18 | 1.8 |
| Licorice Pwd. | 3.00 | 0.66 | 3.00 | 0.66 |
| Marshmallow Rt. Pwd. | 3.30 | 0.73 | 3.30 | 0.73 |
| Slippery Elm Pwd. | 2.00 | 0.44 | 2.00 | 0.44 |
| Caramel Color | 10.00 | 2.2 | 10.00 | 2.2 |
| Blackstrap Molasses | 100.00 | 22.0 | 100.00 | 22.0 |
| Barbados Molasses | 48.10 | 10.6 | 48.10 | 10.6 |
| Glycerine | 30.68 | 6.8 | 30.68 | 6.8 |
| Corn Syrup | 51.72 | 11.4 | 51.72 | 11.4 |
| Salt | 20.70 | 4.6 | 20.70 | 4.6 |
| Ammonium Chloride | 9.91 | 2.2 | 9.91 | 2.2 |
| Sodium Bicarbonate | 20.11 | 4.4 | 20.11 | 4.4 |
| Totals w/o Flav. | 454.00 | 100 | 454.00 | 100 |
| Flavoring | 3.31 | — | 17.67 | — |
| Totals w. Flav. | 457.31 | — | 471.67 | — |

Example 2

TABLE IV

RED RIVER MOIST SNUFF

| | Wintergreen | | Peach/Rum | |
|---|---|---|---|---|
| | Weight (Grams) | % of Total Weight | Weight (Grams) | % of Total Weight |
| Herbal Ingredients | | | | |

TABLE IV-continued

| RED RIVER MOIST SNUFF | Wintergreen | | Peach/Rum | |
|---|---|---|---|---|
| | Weight (Grams) | % of Total Weight | Weight (Grams) | % of Total Weight |
| Alfalfa Leaves | 113.66 | 25.0 | 113.66 | 25.0 |
| Melilotus Leaves | 32.01 | 7.1 | 32.01 | 7.1 |
| Casing Ingredients | | | | |
| Cayenne 5,000 BTU | 8.81 | 1.9 | 8.81 | 1.9 |
| Licorice Pwd. | 3.00 | 0.66 | 3.00 | 0.66 |
| Marshmallow Rt. Pwd. | 3.30 | 0.73 | 3.30 | 0.73 |
| Slippery Elm Pwd | 2.00 | 0.44 | 2.00 | 0.44 |
| Caramel Color | 10.00 | 2.2 | 10.00 | 2.2 |
| Blackstrap Molasses | 100.00 | 22.0 | 100.00 | 22.0 |
| Barbados Molasses | 48.10 | 10.6 | 48.10 | 10.6 |
| Glycerine | 30.68 | 6.8 | 30.68 | 6.8 |
| Corn Syrup | 51.72 | 11.4 | 51.72 | 11.4 |
| Salt | 20.70 | 4.6 | 20.70 | 4.6 |
| Ammonium Chloride | 9.91 | 2.2 | 9.91 | 2.2 |
| Sodium Bicarbonate | 20.11 | 4.4 | 20.11 | 4.4 |
| Totals w/o Flav. | 454.00 | 100 | 454.00 | 100 |
| Flavoring | 3.31 | — | 17.67 | — |
| Totals w. Flav. | 457.31 | — | 471.67 | — |

Example 3

TABLE V

| RED RIVER MOIST SNUFF | Wintergreen | | Peach/Rum | |
|---|---|---|---|---|
| | Weight (Grams) | % of Total Weight | Weight (Grams) | % of Total Weight |
| Herbal Ingredients | | | | |
| Alfalfa Leaves | 93.66 | 20.6 | 93.66 | 20.6 |
| Chicorium Leaves | 20.0 | 4.4 | 20.0 | 4.4 |
| Melilotus Leaves | 32.01 | 7.1 | 32.01 | 7.1 |
| Casing Ingredients | | | | |
| Cayenne 5,000 BTU | 8.81 | 1.9 | 8.81 | 1.9 |
| Licorice Pwd. | 3.00 | 0.66 | 3.00 | 0.66 |
| Marshmallow Rt. Pwd. | 3.30 | 0.73 | 3.30 | 0.73 |
| Slippery Elm Pwd. | 2.00 | 0.44 | 2.00 | 0.44 |
| Caramel Color | 10.00 | 2.2 | 10.00 | 2.2 |
| Blackstrap Molasses | 100.00 | 22.0 | 100.00 | 22.0 |
| Barbados Molasses | 48.10 | 10.6 | 48.10 | 10.6 |
| Glycerine | 30.68 | 6.8 | 30.68 | 6.8 |
| Corn Syrup | 51.72 | 11.4 | 51.72 | 11.4 |
| Salt | 20.70 | 4.6 | 20.70 | 4.6 |
| Ammonium Chloride | 9.91 | 2.2 | 9.91 | 2.2 |
| Sodium Bicarbonate | 20.11 | 4.4 | 20.11 | 4.4 |
| Totals w/o Flav. | 454.00 | 100 | 454.00 | 100 |
| Flavoring | 3.31 | — | 17.67 | — |
| Totals w. Flav. | 457.31 | — | 471.67 | — |

Example 4

TABLE VI

| RED RIVER MOIST SNUFF | Wintergreen | | Peach/Rum | |
|---|---|---|---|---|
| | Weight (Grams) | % of Total Weight | Weight (Grams) | % of Total Weight |
| Herbal Ingredients | | | | |
| Alfalfa Leaves | 125.67 | 27.7 | 125.67 | 27.7 |
| Chicorium Leaves | 20.0 | 4.4 | 20.0 | 4.4 |
| Casing Ingredients | | | | |
| Cayenne 5.000 BTU | 8.81 | 1.9 | 8.81 | 1.9 |
| Licorice Pwd. | 3.00 | 0.66 | 3.00 | 0.66 |
| Marshmallow Rt. Pwd. | 3.30 | 0.73 | 3.30 | 0.73 |
| Slippery Elm Pwd. | 2.00 | 0.44 | 2.00 | 0.44 |
| Caramel Color | 10.00 | 2.2 | 10.00 | 2.2 |
| Blackstrap Molasses | 100.00 | 22.0 | 100.00 | 22.0 |
| Barbados Molasses | 48.10 | 10.6 | 48.10 | 10.6 |
| Glycerine | 30.68 | 6.8 | 30.68 | 6.8 |

TABLE VI-continued

| RED RIVER MOIST SNUFF | Wintergreen | | Peach/Rum | |
|---|---|---|---|---|
| | Weight (Grams) | % of Total Weight | Weight (Grams) | % of Total Weight |
| Corn Syrup | 51.72 | 11.4 | 51.72 | 11.4 |
| Salt | 20.70 | 4.6 | 20.70 | 4.6 |
| Ammonium Chloride | 9.91 | 2.2 | 9.91 | 2.2 |
| Sodium Bicarbonate | 20.11 | 4.4 | 20.11 | 4.4 |
| Totals w/o Flav. | 454.00 | 100 | 454.00 | 100 |
| Flavoring | 3.31 | — | 17.67 | — |
| Totals w. Flav. | 457.31 | — | 471.67 | — |

PREFERRED HERBAL CHEW COMPOSITION

The present invention also includes a tobaccoless, nicotine-free, herbal chewing composition which is capable of forming a coherent cud in the oral cavity during chewing. The general range of components of the present invention as a chewing composition, are shown in the following table.

TABLE VII

| GENERAL FORMULA FOR CHEWING COMPOSITION | |
|---|---|
| Ingredient | % By Weight of Final Product |
| Nicotine-Free Leafy Herb | 40 to 60 |
| Casing Material for Maintaining Herb in Coherent Cud | 8 to 50 |

Preferably, however, the chewing composition also includes additional components such as flavoring and coloring to provide an attractive appearance and enhance the organoleptic acceptability of the product. The preferred general formula is shown below in Table VIII.

TABLE VIII

| PREFERRED GENERAL FORMULA FOR FLAVORED/COLORED CHEWING COMPOSITION | |
|---|---|
| Ingredient | % By Weight of Final Product |
| Nicotine-Free Leafy Herb | 40.00 to 60.0 |
| Casing Material for Maintaining Herb in Coherent Cud | 8.00 to 35.0 |
| Flavor Component | 4.00 to 26.0 |
| Color Component | 0.25 to 05.0 |

In order to prepare a chewing product for ready use by the consumer which can be sustained over a period of time the highly preferred embodiment is shown below in Table IX.

TABLE IX

| HIGHLY PREFERRED GENERAL FORMULA FOR CHEWING COMPOSITION | |
|---|---|
| Ingredient | % By Weight |
| Nicotine-Free Leafy Herb | 45.00 to 55.0 |
| Casing Material for Maintaining Herb in Coherent Cud | 15.00 to 28.0 |
| Flavor Component | 8.00 to 20.0 |
| Color Component | 0.80 to 03.0 |

The casing material, in turn, should include those components which provide a moist coherent cud in the mouth during chewing. It has been found that a suitable casing component can be provided by use of three major functional components, a preservative, a binder and a humectant.

In order to enhance the consumer acceptability of the product, both the chewing and the snuff compositions can include a flavor component, which can be selected from the group consisting of natural and artificial sweeteners, flavoring agents, fruit flavors, spices, and mixtures thereof.

Flavoring agents useful in the present invention include synthetic solid flavoring agents and/or liquids derived from plants, leaves, flowers, fruits and so forth and combinations thereof. Representative flavoring liquids include: spearmint oil, cinnamon oil, oil of wintergreen (*methyl salycilate*) and peppermint oil. Also, artificial and natural fruit flavors such as citric oils, including lemon, orange, grape, lime and grapefruit, as well as fruit essences, including apple, strawberry, cherry and pineapple, can be used.

The color components for use in the present composition can be selected from any food grade color.

A more specific example of the components of the preferred chew composition is provided in Example 5.

Example 5

TABLE X

LEAFY CHEW COMPOSITION

| Ingredients | Weight Grams | Pct of Weight |
|---|---|---|
| Chicory Leaves | 235.00 | 51.8 |
| Casing Sauce | 20.00 | 4.4 |
| Casing Flavor | 20.00 | 4.4 |
| Totals | 454.00 | 100.0 |

One of the problems encountered in the use of various whole or cut plant leaves in a composition is that of maintaining consistent cud in the chewing process, while still avoiding tackiness. Extensive experiments have shown that the use of the alfalfa, in powdered form, serves as a cohesive agent in maintaining the cud over a prolonged time of chewing. The powdered alfalfa also provides bulk and body to the fragile leaves of the chicory, giving it a more tobacco like appearance in its finished form.

The alfalfa powder must be extremely finely ground to a size of from about #30 Duraloy (#20 US) to about #58 Duraloy (#48 US), with a preferred grind of #54 Duraloy (#45 US).

This powder can be directly sprinkled into the cased product, or can be combined and included in the top dressing formula, as shown in Table XII. The top dressing may be applied in an amount of from about 10 to about 50 grams per lb., with about 20 grams preferred use per pound (454 grams) of finished product.

In the composition shown in Example 5, the casing sauce is a complex blend of commercially available humectants, herb powders, including alfalfa, sweeteners, preservatives, and flavors designed to be used as a part of the composition of the leafy chew product. This casing sauce may be altered somewhat in achieving a more acceptable and desirable flavor and taste. The casing sauce also serves to keep the leafy composition in a moistened state over a prolonged period of time, to prevent drying out of the leaf, rendering the leaf stable and pliable during chewing. It also serves to give the product moistness and taste during the chewing action.

Tests have shown that the use of this casing enables the product to retain its flavor and humectant qualities over prolonged periods of time. Product stored as long as 2 years in normal room temperature shows no signs of any type of mold or bacteria content.

TABLE XI

LEAFY CHEW CASING

| INGREDIENTS | Weight Grams | Pct of Weight |
|---|---|---|
| Granulated Raw Sugar | 126.67 | 27.90 |
| Corn Syrup | 116.65 | 25.69 |
| Blackstrap Molasses | 38.00 | 8.37 |
| Glycerine | 30.00 | 6.61 |
| Water | 36.32 | 8.00 |
| Licorice | 1.33 | 0.29 |
| Sodium Chloride | 16.67 | 3.67 |
| Corn Sweetener 62DE | 25.00 | 5.51 |
| Sodium Benzoate | 0.25 | 0.06 |
| Potassium Sorbate | 0.35 | 0.08 |
| Sodium Bicarbonate | 6.67 | 1.47 |
| Peach Conc. (FLOR) | 10.00 | 2.20 |
| Peach Conc. #G23762 (Globe) | 5.00 | 1.10 |
| Peach Conc. #G23772 (Globe) | 5.00 | 1.10 |
| Fig Conc. | 10.00 | 2.20 |
| Vanilla #600 | 4.67 | 1.03 |
| Oil/Chocolate (40 lb.) #116264 | 2.33 | 0.51 |
| Maple Flavor 7556 | 2.67 | 0.59 |
| Caramel Color | 16.1 | 3.55 |
| E-Z Resin Capsicum (100) #880307 | 0.036 | 0.01 |
| Spice-N-Easy Anise/200 LB #810276 | 0.163 | 0.04 |
| Antifoam "C" Emulsion | 0.13 | 0.03 |
| TOTALS | 454.00 | 100.00 |

For the casing of this example, granulated raw sugar was obtained from Amstar Corp., American Sugar Division of New York, N.Y., as was blackstrap molasses; corn syrup and corn sweetener were obtained from ADM Milling Co., of Shawnee Mission, Kan.; glycerine was obtained from Bio-Bottanica, Inc., of Hauppauge, N.Y.; spray dried licorice was obtained from McAndrews & Forbes of Camden, N.J.; sodium chloride was obtained from Morton Salt Corp. of Chicago, Ill.; sodium benzoate and potassium sorbate were obtained from Pfizer Corp., Chemical Division of New York, N.Y.; bicarbonate of soda was obtained from Ashland Chemical Co. of Columbus, Ohio; peach juice concentrate was obtained from Florasynth Co. of New York, N.Y., and from Globe Extracts Co., of Hauppauge, N.Y.; fig juice concentrate was obtained from Vi-Del Co. of Fresno, Calif.; vanilla was obtained from Bell Flavors of Northbrook, Ill.; oil of chocolate was obtained from Nestle Co., Bulk Chocolate Division of White Plains, N.Y.; maple flavor was obtained from Globe Extracts of Hauppauge, N.Y.; caramel color was obtained from Sethness Products of Chicago, Ill.; resin capsicum was obtained from Fidco, a subsidiary of Nestle Co. of White Plains, N.Y.; and antifoam "C" emulsion was obtained from Dow Corning Laboratories of Midland, Mich.

TABLE XII

LEAFY CHEW TOP DRESSING

| Ingredients | Weight Grams | Pct. of Weight |
|---|---|---|
| Granulated Raw Sugar | 295.00 | 64.98 |
| S.M.E. Powder | 64.26 | 14.15 |
| Spanish Licorice | 46.82 | 10.31 |
| Cocoa Powder (8–12%) | 7.72 | 1.70 |
| Magna-Sweet 135 | 1.20 | 0.26 |
| Magna-Sweet A.G. | 1.60 | 0.35 |
| Alfalfa Powder | 20.40 | 4.49 |
| Cayenne Powder (20,000 B.T.U.) | 2.00 | 0.44 |

TABLE XII-continued

| LEAFY CHEW TOP DRESSING | | |
|---|---|---|
| Ingredients | Weight Grams | Pct. of Weight |
| Ginger Root Powder | 15.00 | 3.30 |
| TOTALS | 454.00 | 100.00 |

For this example, granulated raw sugar was obtained from Amstar Corp., American Sugar Division of New York, N.Y.; S.M.E. Powder and Spanish licorice were obtained from McAndrews & Forbes of Camden, N.J., as were the sweeteners, Magna-Sweet 135 and Magna-Sweet A.G.; cocoa powder was obtained from Braun & Sons Co., Inc. of Lake Success, N.Y.; ginger powder and alfalfa powder were obtained from Dro Madis Laboratories, Inc., South Hackensack, N.J.; and cayenne powder was obtained from Cal-Compack Foods of Santa Ana, Calif.

The casing sauce is created by careful blending and homogenizing of the ingredients. For use in the composition, it is heated to a temperature of from 140° to 155° F. The leaves are then dipped in this casing sauce for approximately 5 minutes. The casing sauce is then wrung out of the leaves, either by pressing or by centrifugal force, leaving the desired percentages of casing as an integral part of the product.

The casing powder in Example 5 is a commercially available blend of powders such as cocoa, sugar, coffee, etc. designed to be sprinkled over the moistened and cased leaves as in this composition. This powder increases the bulk of the product, further darkens the leaves, and provides taste to the user. In most cases, the ginger root powder and cayenne powder are blended together with this casing powder and applied in one operation.

The casing flavor in Example 5 is a liquid flavoring added to give the final touch of flavor and taste to the finished product. The quantity of casing flavors is adjusted according to the intensity of the flavor desired in any given version of the product.

Thus, while we have described what are presently the preferred embodiments of the present invention, other and further changes and modifications could be made without departing from the spirit and scope of the invention, and it is intended by the inventors to claim all such changes and modifications.

We claim:

1. A composition for use as a chew or snuff, including a nicotine-free herb component capable of being encased and capable of being processed to a texture which is non-injurious to the surface of the oral cavity comprising alfalfa, and a casing component comprising means for combining with said herb component which maintains said herb component in a moist coherent cud during chewing, said casing comprising a flavor component that includes cayenne pepper in amounts sufficient to approximate the bite sensation of a tobacco-containing chew or snuff composition, wherein said flavor component of said casing comprises a base casing component including cayenne pepper and a top dressing component including cayenne pepper; and wherein from about 70% to about 80% of the total weight of said cayenne pepper is included in said base casing component and from about 20% to about 30% of the total weight of said cayenne pepper is included in said top dressing component.

2. A composition as recited in claim 1, wherein said cayenne pepper has a heat content of from about 5,000 BTU to less than about 10,000 BTU.

3. A composition as recited in claim 2, wherein said cayenne pepper has a heat content of about 5,000 BTU.

4. A composition as recited in claim 1, wherein said cayenne pepper is included in an amount of from about 0.1% to about 4.0% of the overall weight of the composition.

5. A composition as recited in claim 4, wherein said cayenne pepper is included in an amount of from about 0.15% to about 3% of the overall weight of the composition.

6. A composition as recited in claim 5, wherein said cayenne powder is included in an amount of about 1.9% of the overall weight of the composition.

7. A composition as recited in claim 1, wherein said casing comprises 19% cayenne pepper, 0.66% licorice powder, 0.73% marshmallow root powder, 0.44% slippery elm powder, 2.2% caramel color, 22% blackstrap molasses, 10.6% Barbados molasses, 6.8% glycerine, 11.4% corn syrup, 4.6% salt, 2.2% ammonium chloride, and 4.4% sodium bicarbonate, based on the total weight of the composition.

8. A composition as recited in claim 1, wherein said herb component comprises alfalfa and chicory, clover, or a mixture thereof.

9. A process for preparing a composition for use as a chew or snuff providing a sustained organoleptic bite sensation, said composition including a nicotine-free herb component comprising alfalfa and capable of being encased and capable of being processed to a texture which is non-injurious to the surface of the oral cavity, and a casing applied thereto which provides a moist coherent cud in the oral cavity upon use, said process comprising the steps of:

(i) adding a first portion of cayenne pepper as an ingredient in a base casing component of said casing;

(ii) encasing said herb component in base said casing; and (iii) adding a second portion of cayenne pepper as an ingredient in a top dressing component of said casing;

further comprising adding from about 70% to about 80% of the total weight of said cayenne pepper as an ingredient in said base casing component, and adding from about 20% to about 30% of the total weight of said cayenne pepper as an ingredient in said top dressing component.

10. A process as recited in claim 9, further comprising selecting said cayenne pepper having a heat content of from about 5,000 BTU to less than about 10,000 BTU.

11. A process recited in claim 10, further comprising selecting said cayenne pepper having a heat content of about 5,000 BTU.

12. A process as recited in claim 9, further comprising adding said cayenne pepper in an amount of from about 0.1% to about 4.0% of the overall weight of the composition.

13. The process recited in claim 12, further comprising adding said cayenne pepper in an amount of from about 0.15% to about 3.0% of the overall weight of the composition.

14. The process recited in claim 13, further comprising adding said cayenne pepper in an amount of about 1.9% of the overall weight of the composition.

15. A process as recited in claim 9, further comprising selecting as ingredients of said casing comprises 1.9% cayenne pepper, 0.66% licorice powder, 0.73% marshmallow root powder, 0.44% slippery elm powder, 2.2% caramel color, 22% blackstrap molasses, 10.6% Barbados molasses, 6.8% glycerine, 11.4% corn syrup, 4.6% salt, 2.2% ammonium chloride, and 4.4% sodium bicarbonate, based on the total weight of the composition.

16. The process as recited in claim 9, further comprising selecting as said herb component: alfalfa and chicory, clover, or a mixture thereof.

* * * * *